US005091612A

United States Patent [19]

Van Fossen

[11] Patent Number: 5,091,612

[45] Date of Patent: Feb. 25, 1992

[54] MAGNETICALLY ACTUATED PROXIMITY FLOW SWITCH

[75] Inventor: Robert A. Van Fossen, Auburn, Ind.

[73] Assignee: Johnson Service Company, Milwaukee, Wis.

[21] Appl. No.: 606,102

[22] Filed: Oct. 31, 1990

[51] Int. Cl.[5] ..... H01H 35/40

[52] U.S. Cl. ..... 200/81.9 M; 73/861.75; 340/610

[58] Field of Search ..... 307/118; 338/32 H; 340/610 X; 200/81.9 R, 81.9 M; 73/861.74, 861.75 X, 861.76, 861.77, 272 R

[56] References Cited

U.S. PATENT DOCUMENTS

| | | | |
|---|---|---|---|
| 3,564,171 | 2/1971 | Hammond | 200/61.52 |
| 4,071,725 | 1/1978 | Smith | 200/82 F |
| 4,377,090 | 3/1983 | Seulen | 73/861.74 |
| 4,443,671 | 4/1984 | Hinds | 200/81 R |
| 4,827,092 | 5/1989 | Kobold | 200/81.9 M |

OTHER PUBLICATIONS

Fluid Flow Switch, Mod. Q-9, Harwil Corporation, Apr. 1986.

Water Flow Switch, Mod. Q-10, Harwil Corporation, Nov. 1989.

*Primary Examiner*—Gerald P. Tolin

*Attorney, Agent, or Firm*—Foley & Lardner

[57] ABSTRACT

A flow switch adapted to be attached to a pipe is designed to trip a switch at a preset flow rate. The switch employs a bending metal blade which deflects in the flow stream to move a magnet attached to the downstream side of the blade relative to a reed switch or Hall-effect switch. The switching device is preferably mounted in a slot on a printed circuit board to enable selection of a range of available trip points.

24 Claims, 2 Drawing Sheets

MAGNETICALLY ACTUATED PROXIMITY FLOW SWITCH

FIELD OF THE INVENTION

The present invention relates generally to flow measuring devices, more particularly to a flow switch which may be disposed in a pipe to measure the rate of fluid flow therethrough. Still more specifically, the present invention is directed to a switch for measuring very low flow rates.

BACKGROUND OF THE INVENTION

Many switches have been developed for measuring the flow of fluid through a pipe. Several such devices rely on the pivotal movement of a rod supported blade which is deflected depending on the amount of fluid flow. For example, in Miller U.S. Pat. No. 3,303,852 issued Feb. 14, 1967, a paddle is displaced due to the flow of liquid, the blade being attached to a rigid rod that pivots in a rubber coupling. The paddle is disposed transversely of the direction of flow so as to move the actuator rod in a counterclockwise direction in response to flow of fluid. The paddle is sufficiently light so that, at higher rates of flow, it deflects into a position out of the flow path to decrease pressure drop through the area of the switch. In Simons, et al. U.S. Pat. No. 4,282,413 issued Aug. 4, 1981, a flow indicator for an automatic sprinkler includes a flexible one-piece plastic vane having a generally circular portion disposed transversely within the pipe. Flow of water through the line causes a magnet at the upper portion of the vane to move into proximity with a sensor to complete an electrical circuit and generate a signal indicating that the water line has been opened. The blade is adapted to move generally parallel to the flow when the line is open.

An additional flow detector employing a pivotal mechanism is shown in Graves U.S. Pat. No. 4,614,122 issued Sept. 30, 1986. This device includes a saddle held in sealing relation to a conduit through an adapter. The adapter includes an aperture that cooperates with an aperture in the conduit through which the actuator of the detector extends. Rod movement dependent upon flow, the rod being spring biased, operates a switch to detect a preset flow condition. See also Miller, et al. U.S. Pat. No. 3,536,873 issued Oct. 27, 1970, which describes a switch which monitors flow of coolant in an engine and provides a warning signal if flow falls below a preset level. This switch employs a diaphragm composed of a material such as an elastomer, and an elongate member pivotally supported, for example, by a washer to provide electrical communication between the elongated member, its electrical contact point and a switch body.

Two other known flow switches include the Q9 and Q10 models sold by the Harwil Corporation of Santa Monica, California. The Q9 includes a reed switch potted in a housing and a bending beam adjacent thereto. The bending beam supports a magnet housing which is caused to bend away from the reed switch housing at the onset of high flow conditions, thereby causing an electrical impulse to indicate the start-up flow condition. The Q10 includes a blade holding a magnet which moves toward a tube-like housing in the flow area, which housing contains a reed switch. The housing also acts as a stop for limiting further blade movement. The Harwil device requires large movement of the magnet to achieve switch closure and would require a different bending blade for each set point.

Flexible blades are shown in Clark, et al. U.S. Pat. No. 4,468,532 issued Aug. 28, 1984. One portion of a conductor is fastened to the housing and another portion is movable when fluid pressure is applied through a passage to force the moveable portion into contact with electrical terminals. This device is designed for switching in a remote, high temperature environment subject to high centrifugal forces which may also be limited by space. Another fluid flow transducer is disclosed in Pisors U.S. Pat. No. 3,629,532 issued Dec. 21, 1971. This device, designed for regulating fuel in feed lines, includes a normally closed resilient moveable contact which is directly impinged by flowing fuel to open an electrical circuit to generate signals which are indicative of the rotational speed of an engine and the frequency and time variation of fuel flow through each fuel line. A center aperture of a contact plate includes the contact surface extending between the center of the aperture and formed integrally in one piece with a contact plate. Electrical current flow is established through movement of the resilient contact surface and is sent to an oscilloscope, a timing light or the like.

Another known flow switch uses a spring loaded piston, rather than a pivoting blade. As the fluid flow rate increases, a piston is pushed back against a spring. A magnet mounted on the piston moves proximately to a reed switch and triggers the switch once the piston travels a sufficient distance.

Each of the foregoing devices suffers from disadvantages which are significant when precise determination of low flow rates is desired. Pivoting systems are particularly troublesome in that they tend to accumulate debris at the pivot area which can cause jamming and prevent proper functioning. Moreover, present designs do not permit the establishment of different flow levels for switch operation. The present invention addresses these disadvantages.

SUMMARY OF THE INVENTION

A flow switch of the invention has a resilient blade which deflects in the flow to move a magnet carried by the blade relative to a magnetically actuated switch, such as a reed switch or Hall-effect switch (transducer). Suitable means are provided for mounting the switch in any one of a predetermined number of possible positions relative to the blade and magnet, with each position corresponding to a different flow rate threshold for tripping the switch. According to another aspect of the invention, the switch is mounted substantially perpendicular to the length of the blade on a printed circuit board having elongated slots which hold it to the housing.

The sensor of the present invention provides numerous benefits, including adjustability of the set point, parallel motion which allows switch closure with a minimum of magnet travel distance, and high accuracy at very low flow rates, as low as 0.3 gallons per minute (GPM). Maximum flow rate can exceed 15 times the detectable minimum flow. The housing of the invention may be made from FDA-approved materials for connection to standard fittings, and may be used at temperatures up to 250° F.

Another feature of the switch of the present invention is an internal nozzle which directs the fluid stream into the center of the bending blade to increase overall system sensitivity.

BRIEF DESCRIPTION OF THE DRAWING

A preferred exemplary embodiment of the invention will be described in conjunction with the appended drawing, wherein like numerals denote like elements, and.

DETAILED DESCRIPTION OF A PREFERRED EMBODIMENT

Figure 1:
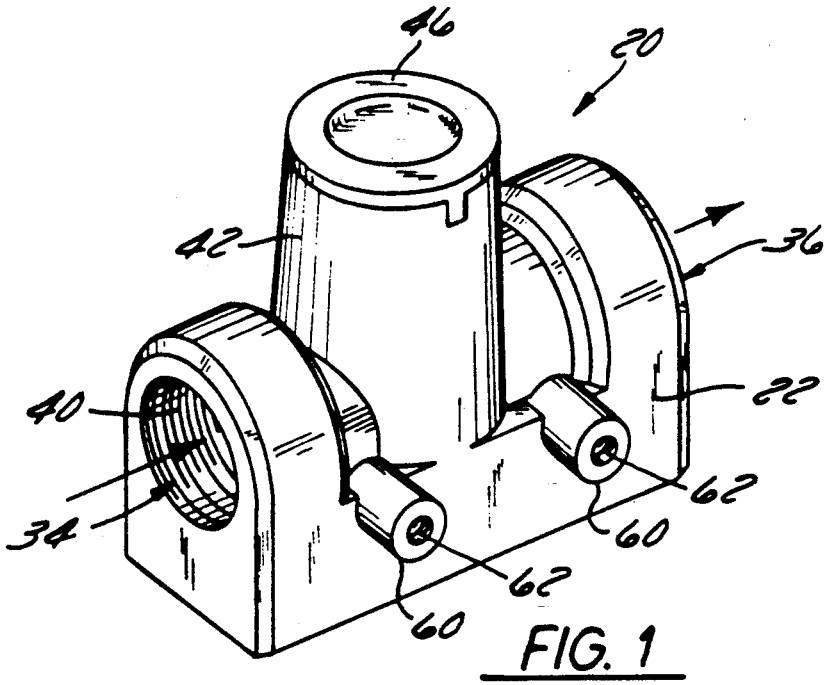
FIG. 1 is a perspective view of a flow switch in accordance with the present invention.
Figure 2:
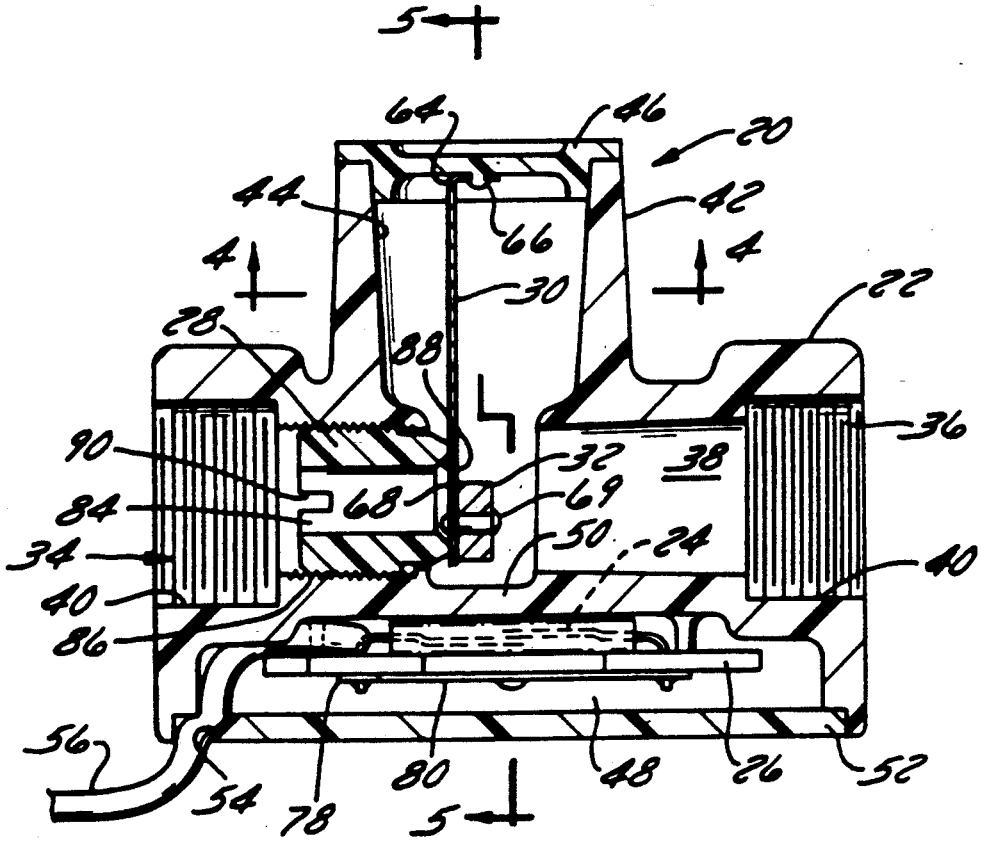
FIG. 2 is a front, lengthwise cut away view of the switch shown in FIG. 1.

Referring to FIGS. 1 and 2, a flow switch 20 according to the invention includes a housing 22, a reed switch 24, an adjustable printed circuit (PC) panel 26, a nozzle 28, a resilient blade (leaf spring) 30, and a magnet 32. Flow switch 20 is normally mounted in a pipeline (not shown) and used to measure flow rate. When fluid flow through the pipe reaches a certain level, flow switch 20 triggers, causing another device to initiate functions dependent on a certain amount of flow.

According to a preferred embodiment, housing 22 is a pipe coupling or fitting which conducts the flow of fluid through flow switch 20. Housing 22 includes a fluid inlet 34 and a fluid outlet 36 at opposite ends of a lengthwise fluid flow passage 38. Inlet 34 and outlet 36 are preferably counterbores each having internal threads 40 so that fluid flow pipes can be threadedly coupled to flow switch 20.

An upper cylindrical projection 42 of housing 22 extends upwardly and perpendicularly to fluid flow passage 38. such that the interior of housing 22 is generally T-shaped. Upper projection 42 has a hollow interior (side chamber) 44 which communicates with fluid flow passage 38. A circular cover 46 is affixed to the top of upper projection 42, preferably by an ultrasonic weld.

Along the bottom of housing 22 is a downwardly opening cavity 48 which houses reed switch 24 and PC panel 26. Open cavity 48 is separated from fluid flow passage 38 by a wall 50 of housing 22. This prevents obstruction of fluid flow by keeping reed switch 24 out of the flow path. A lower cover 52 encloses cavity 48 and is preferably attached to housing 22 by an ultrasonic weld. Disposed at one end of lower cover 52 is a recessed groove 54 through which respective coated wires, 56 and 58, extend for attachment to PC panel 26.

Respective mounting bosses 60 extend outwardly from one side of housing 22. Each boss has an internally threaded hole 62 which can receive an appropriately sized fastener. This facilitates the mounting of flow switch 20 to a rigid vertical surface.

Blade 30 includes a bent end flange 64 which is attached to the inside of circular cover 46 by meltforming the ends of two plastic pins into respective heads 66. The pins locate the mounting position of blade 30 and, when melted, heads 66 hold blade 30 against the underside of circular cover 46. Blade 30 extends downwardly through hollow interior 44 and into passage 38, so that fluid flowing through fluid flow passage 38 will contact a distal end portion 68 of blade 30 and cause it to flex. In a preferred embodiment, movement of blade 30 is due solely to flexing rather than pivoting in order to minimize the number of moving parts which tend to bind in the presence of debris. Blade 30 is attached to cover 46 at the top of projection 42 so that blade 30 may have greater length. This greater length provides for more uniform flexing and movement of distal end 68 in an initially generally parallel direction with the fluid flow.

Magnet 32 is attached by a nonferrous rivet 69 or some other appropriate fastener to distal end 68 of blade 30 on the downstream side of blade 30. Under sufficient fluid flow conditions, blade 30 will flex and magnet 32 will move within fluid flow channel 38 in the direction of fluid flow.

Blade flex varies depending on the amount of fluid flow as well as the material and dimensions of blade 30. Blade 30 is designed for a specific amount of flex for a given flow of fluid. In a preferred embodiment, blade 30 is made of 0.005" thick 302 stainless steel. Such a blade measures fluid flow as low as 0.3 gallons per minute. As fluid flow increases, blade 30 flexes until magnet 32 abuts the upper surface of passage 38. In this position blade 30 and magnet 32 are substantially out of the path of fluid flow, providing less obstruction to the fluid at greater flow rates. Magnet 32 is preferably a permanent magnet approximately 0.4" wide, 0.25" high and 0.125" thick with a field strength of approximately 120 gauss min at 0.200".

Reed switch 24 is of the type MRPR-2 manufactured by Hamlin Incorporated and is hard wired to PC panel 26. Reed switch 24 typically has conductors which are separated, preventing current flow. When magnet 32 passes within sufficient proximity, the conductors are pulled together, allowing current to pass through the switch. Wall 50 separates reed switch 24 from magnet 32, although magnet 32 is in close proximity to reed switch 24. When magnet 32 moves sufficiently close to reed switch 24, switch 24 is triggered, thus completing the circuit into which reed switch 24 is wired and activating or deactivating a device such as a water heater.

Figure 3:
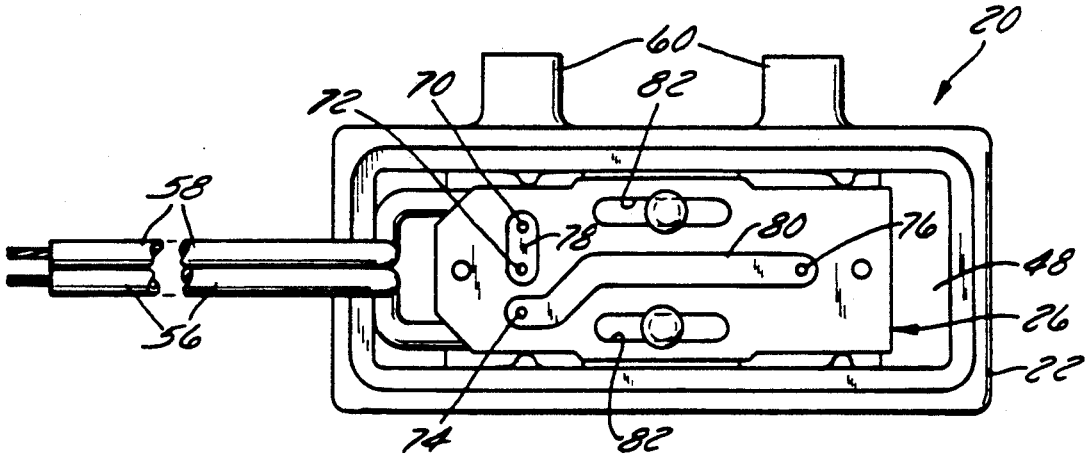
FIG. 3 is a bottom view of the switch of FIG. 1 with the bottom cover removed.
Figure 5:
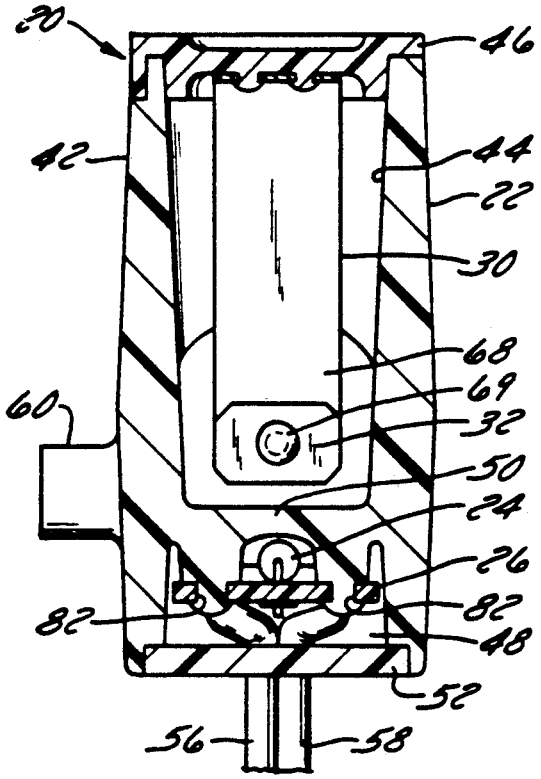
FIG. 5 is a cross sectional view of the flow switch taken along line 5—5 in FIG. 2.
Figure 4:
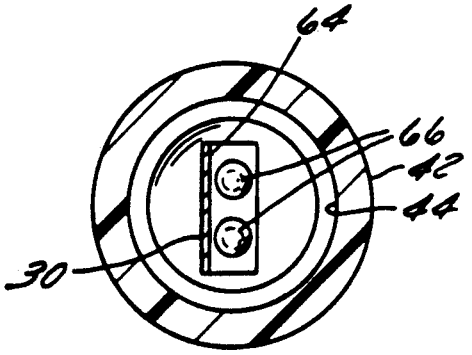
FIG. 4 is a cross sectional view taken along line 4—4 in FIG. 2.

Referring to FIG. 3, PC panel 26 includes respective contact points 70, 72, 74 and 76. A first conductor 78 connects points 70 and 72, while a second conductor 80 connects contact points 74 and 76. Lead wires 56 and 58 are connected to contact points 74 and 70, respectively, and reed switch 24 is wired between contact points 72 and 76. Current can thus flow between lead wire 56 and lead wire 58 when reed switch 24 is triggered.

Respective slots 82 are formed through PC panel 26 and extend lengthwise in the direction of flow when PC panel 26 is mounted in cavity 48. Slots 82 provide for adjustable attachment of PC panel 26 to housing 22. Typically, a pair of pins 83 extend through slots 82 and are melt-formed to secure PC panel 26, although other fastening means, such as screws, could be used. If a reversible, removable fastener such as a set screw is used, PC panel 26 and reed switch 24 can be moved ahead in the direction of fluid flow (indicated by an arrow in FIG. 1) or back in the opposite direction by refastening PC panel 26 to housing 22 at any one of a range of different locations along slots 82.

By moving PC panel 26 and attached reed switch 24 ahead, magnet 32 will necessarily travel further before triggering reed switch 24. This will require a greater fluid flow rate through passage 38 in order for blade 30 to flex the additional distance. Consequently, the fluid flow rate at which reed switch 24 is triggered can be controlled by moving PC panel 26 forward or back. In the illustrated embodiment, reed switch 24 can be triggered at flow rates ranging from 0.3 gallons per minute to 1.0 gallons per minute.

In order to gain more sensitivity to lower flow rates, a nozzle 28 is inserted into passage 38 upstream from blade 30. Nozzle 28 includes a nozzle passage 84 having a smaller diameter than fluid passage 38 so that the force of the water impinging against the central area of the blade 30 is intensified. Nozzle 28 is preferably tubular and has an external threaded surface 86 for threaded engagement with mating threads formed on the interior of fluid flow passage 38. Nozzle passage 84 extends longitudinally through the center of nozzle 28. Fluid flows through nozzle passage 84 and leaves through a flared outlet 88, on the downstream side of nozzle 28, before striking blade 30. The front of blade 30 covers the rim of outlet 88 when blade 30 is at rest, as shown in FIG. 2. A groove 90 in the upstream end of nozzle 28 provides for quick insertion and removal of nozzle 28 with the aid of a flat-headed screwdriver or similar tool. Nozzles having differently sized nozzle passages can be used to vary sensitivity to flow. Larger passage diameters lower the sensitivity of switch 20.

It will be understood that the above description is of a preferred exemplary embodiment of the invention and that the invention is not limited to the specific form shown. For example, flow switch 20 can be made from various materials and in various sizes and configurations. In the embodiment shown, structural members are made of a tough, durable plastic. By repositioning the switch to a normally open position, the switch can be converted to disconnect current flow through the switch when fluid flow reaches a certain magnitude. The switch may be housed separately from blade and mounted to the exterior of an existing pipeline. Various other substitutions, modifications, changes, and omissions may be made in the design and arrangement of the elements without departing from the spirit of the invention as expressed in the appended claims.

What is claimed is:

1. A flow switch, comprising:

a housing having a flow passage extending therethrough;

a resilient blade mounted on said housing, said blade being disposed substantially normal to a fluid flow path through said flow passage with a distal end of said blade extending into the fluid flow path to provide bending movement of said blade in the direction of the fluid flow;

a magnet affixed to said distal end of said blade for movement in unison with said distal end;

a magnetically actuated switch disposed proximate to said magnet and out of said fluid flow path;

adjustable fastener means for selectively positioning said switch relative to said magnet in a plurality of positions corresponding to different minimum flow rates for actuating said switch, and securing said switch to said housing in one of said positions; and means for electrically connecting said switch to a device to be controlled when said magnet actuates said switch.

2. The flow switch of claim 1, wherein said switch comprises a reed switch.

3. The flow switch of claim 1, wherein said flow passage includes a pair of internally threaded counterbores, disposed respectively at an inlet to said flow passage and at an outlet from said flow passage, for facilitating the mounting of said flow switch in line with a fluid pipeline.

4. The flow switch of claim 1, wherein said housing includes a hollow projection in which said blade is mounted, which projection is disposed normal to said flow passage such that the interior of said housing is generally T-shaped.

5. The flow switch of claim 1, further comprising a nozzle mounted in said flow passage to constrict the flow of fluid through said flow passage.

6. The switch of claim 1, wherein said switch is positioned substantially perpendicular to the lengthwise direction of said blade and generally parallel to the direction of fluid flow.

7. The flow switch of claim 1, wherein said switch is mounted in a cavity in said housing isolated from said flow passage.

8. The flow switch of claim 7, wherein said nozzle is generally tubular and has external threads which engage mating threads formed on the interior surface of said flow passage, and is positioned such that a front face of said blade engages a rear end of said nozzle when said blade is at rest, said magnet being disposed on a rear face of said blade opposite said nozzle.

9. A flow switch, comprising:

a housing;

a resilient blade mounted on said housing, said blade being disposed substantially normal to a fluid flow path with a distal end of said blade extending into the fluid flow path to provide bending movement of said blade in the direction of the fluid flow;

a magnet affixed to said distal end of said blade for movement in unison with said distal end;

a magnetically actuated switch disposed proximate to said magnet out of said fluid flow path, said switch being positioned substantially perpendicular to the lengthwise direction of said blade and generally parallel to the direction of fluid flow, such that bending movement of said blade in response to fluid flow causes the distance between said magnet and said switch to vary, actuating said switch at a predetermined flow rate; and means for electrically connecting said switch to a device to be controlled when said magnet actuates said switch.

10. The flow switch of claim 9, wherein said blade and said flow passage are configured to permit bending movement of said blade substantially out of said fluid flow path at a sufficiently high fluid flow rate.

11. The flow switch of claim 9, wherein said blade can actuate said switch at a flow rate as low as 0.3 gallons per minute.

12. The flow switch of claim 9, wherein said switch comprises a reed switch which is elongated in the lengthwise direction of fluid flow.

13. A flow switch, comprising:

a housing which includes an internal flow passage extending through said housing, coupling means at opposite ends of said flow passage for mounting said flow switch in line with a fluid pipeline, and a hollow side chamber adjoining said flow passage;

a resilient blade mounted on said housing in said side chamber and extending therefrom into said flow passage, said blade being disposed substantially normal to said fluid flow passage with a distal end of said blade extending into the fluid flow passage to provide bending movement of said blade in the direction of the fluid flow through said passage;

a magnet affixed to said distal end of said blade for movement in unison with said distal end;

a magnetically actuated switch disposed proximate to said magnet, said switch being positioned substantially perpendicular to the lengthwise direction of said blade and generally parallel to the direction of fluid flow, such that bending movement of said blade in response to fluid flow causes the distance between said magnet and said switch to vary, actuating said switch at a predetermined flow rate threshold value;

adjustable fastener means for selectively positioning said switch relative to said magnet in a plurality of positions corresponding to different minimum flow rates for actuating said switch, and securing said switch to said housing in one of said positions; and means for electrically connecting said switch to a device to be controlled when said magnet actuates said switch.

14. The flow switch of claim 13, further comprising a nozzle mounted in said flow passage having a central opening of lesser diameter than said flow passage to constrict the flow of fluid through said flow passage.

15. The flow switch of claim 14, wherein said blade comprises a thin leaf spring having a front surface and a back surface, such that a portion of said front surface at said distal end of said blade contacts said nozzle when said blade is in an unbent position, and said magnet is secured to said back surface of said blade at said distal end of said blade opposite said nozzle.

16. The flow switch of claim 13, wherein said switch is disposed in a cavity in said housing, which cavity is longer than said switch, permitting said switch to be mounted over a plurality of positions in said cavity along the lengthwise direction of said cavity parallel to the fluid flow direction.

17. The flow switch of claim 16, further comprising a panel on which said switch is mounted, and said fastener means secures said panel within said cavity in said one said plurality of positions.

18. The flow switch of claim 17, wherein said fastener means comprises a pin which extends from said housing disposed in an elongated slot in said panel, and means for retaining the said pin in said slot.

19. The flow switch of claim 17, wherein said means for electrically connecting said switch to a device further comprises wires extending into said cavity, and electrical connections on said panel connecting said wires to said switch.

20. The flow switch of claim 19, wherein said housing further comprises a first cover which closes a top end of said side chamber, said blade being mounted to an inner surface of said first cover, and a second cover enclosing said cavity, said second cover having an opening through which said wires extend.

21. The flow switch of claim 15, wherein said coupling means comprises a pair of internally threaded counterbores, disposed respectively at an inlet to said flow passage and at an outlet from said flow passage.

22. The flow switch of claim 21, wherein said nozzle has external threads on the outer circumferential surface thereof which engage threads formed on the inner surface of said flow passage, inwardly of said counterbores, permitting said nozzle to be adjustably secured in said flow passage over a range of positions along the lengthwise direction of said flow passage.

23. The flow switch of claim 13, wherein said switch comprises a reed switch.

24. The flow switch of claim 13, wherein said blade and said flow passage are configured to permit bending movement of said blade substantially out of said fluid flow path at a sufficiently high fluid flow rate.

* * * * *

UNITED STATES PATENT AND TRADEMARK OFFICE

CERTIFICATE OF CORRECTION

PATENT NO. : 5,091,612

DATED : February 25, 1992

INVENTOR(S) : Robert A. Van Fossen

It is certified that error appears in the above-identified patent and that said Letters Patent is hereby corrected as shown below:

Column 8, line 6, claim 17, "said plurality of positions." should read --position.--.

Signed and Sealed this

Twenty-first Day of September, 1993

Bruce Lehman

*Attest:*

BRUCE LEHMAN

*Attesting Officer*

*Commissioner of Patents and Trademarks*